US005522750A

United States Patent [19]

Mera et al.

[11] Patent Number: 5,522,750

[45] Date of Patent: Jun. 4, 1996

[54] CATHODE-RAY TUBE HAVING UNITARY ELECTRODE PLATE OF DIFFERENT THICKNESSES

[75] Inventors: Takeshi Mera; Satoru Endo; Mitsuhiro Sugiyama, all of Mobara, Japan

[73] Assignee: Hitachi, Ltd., Tokyo, Japan

[21] Appl. No.: 450,707

[22] Filed: May 25, 1995

Related U.S. Application Data

[62] Division of Ser. No. 64,639, May 21, 1993.

[30] Foreign Application Priority Data

May 26, 1992 [JP] Japan ..... 4-133182

[51] Int. Cl.[6] ..... H01J 9/14

[52] U.S. Cl. ..... 445/49

[58] Field of Search ..... 445/49

[56] References Cited

U.S. PATENT DOCUMENTS

| | | | |
|---|---|---|---|
| 3,767,953 | 10/1973 | Bossers | 445/49 X |
| 4,520,292 | 5/1985 | van Hekken et al. | 313/412 |
| 4,605,880 | 8/1986 | McCandless et al. | 313/414 |
| 4,812,706 | 3/1989 | Baudry et al. | 313/414 |
| 4,992,698 | 2/1991 | Lundvall, II | 313/414 X |
| 5,196,762 | 3/1993 | Go | 313/414 |

*Primary Examiner*—Kenneth J. Ramsey
*Attorney, Agent, or Firm*—Antonelli, Terry, Stout & Kraus

[57] ABSTRACT

A cathode-ray tube having an electron gun which includes an electrode plate (E) in which a portion having three beam passage holes (H) and a portion having bead supports (S) are formed as a unitary structure, the two portions having different thicknesses ($T_1$, $T_2$), and the steps being inclinedly formed along the boundaries of the two portions. Since the portion having beam passage holes and the portion having bead supports are formed as a unitary structure easily and highly precisely in the electrode plate, the conventionally employed process of welding can be omitted, and thereby the productivity is raised and the manufacturing cost is decreased. Moreover, use of the material having the steps formed in advance contributes to increasing the productivity and preventing the machining tools from being damaged during the press-forming.

5 Claims, 12 Drawing Sheets

CATHODE-RAY TUBE HAVING UNITARY ELECTRODE PLATE OF DIFFERENT THICKNESSES

This application is a Division of application Ser. No. 08/064,639, filed May 21, 1993.

BACKGROUND OF THE INVENTION

1. Field of the Invention

The present invention relates to a cathode-ray tube and, particularly, to an improvement of an electrode plate which constitutes an electron gun of a cathode-ray tube.

2. Prior Art

A cathode-ray tube (hereinafter referred to as a color cathode-ray tube) used for color image display is constituted by a panel unit which is an image screen, a neck unit which holds an electron gun, and a funnel unit which couples the panel unit to the neck unit. In the funnel unit is mounted a deflector which causes an electron beam emitted from the electron gun to scan a fluorescent screen applied to the inner surface of the panel.

The electron gun held in the neck unit is provided with various electrodes such as a cathode electrode, a control electrode, a focusing electrode and an acceleration electrode. The electron beam from the cathode electrode is modulated by a signal applied to the control electrode, and is permitted to impinge on the fluorescent screen after having been imparted with a required sectional shape and energy through the focusing electrode and the acceleration electrode. In the course of arriving at the fluorescent screen from the electron gun, the electron beam is deflected in a horizontal direction and in a vertical direction by the deflector provided in the funnel unit so as to form an image on the fluorescent screen (Japanese Patent Laid-Open No. 215640/1984).

FIG. 16(*a*) is a plan view of an electrode (G3 electrode) which constitutes the electron gun provided in a conventional cathode-ray tube, and FIG. 16(*b*) is a sectional view of the G3 electrode along the line B—B' of FIG. 16A. In these drawings, symbol G3 denotes a G3 electrode, $E_1$ denotes a first electrode plate which constitutes the G3 electrode G3, symbol $E_2$ denotes a second electrode plate which constitutes the G3 electrode G3, symbols H denote beam passage holes. Each of the first and second electrode plates $E_1$, $E_2$ has three in-line beam passage holes H. Symbols S denotes bead supports (supports of bead glass not shown) provided to the first electrode plate $E_1$.

A conventional G3 electrode G3 has been formed by welding two electrode plates together, i.e., by welding together a first electrode plate $E^1$ having bead supports S and a second electrode plate $E_2$ having three beam passage holes H. Therefore, the thickness of the first electrode plate $E_1$ where bead supports S are formed is different from that of the second electrode plate $E_2$ where the beam passage holes H are bored, developing steps in the boundary between the two. The reason why the plates with different thicknesses are use and a step is formed is to decrease the gap between the G2 electrode (not shown) and the G3 electrode G3 in order to improve the focusing performance without deteriorating the breakdown voltage characteristics.

Conventionally, as shown in FIG. 16, since two electrode plates $E_1$ and $E_2$ are welded together, the productivity is low and the manufacturing cost is high. Furthermore, when a piece of electrode plate is subjected to coining by press-machining in order to obtain an electrode having a step, there arises a problem that the tools are often damaged due to the lack of sufficient strength.

SUMMARY OF THE INVENTION

The object of the present invention is to produce an electrode plate with a step where a portion having beam passage holes and a portion having bead supports are formed in one body, maintaining a good productivity without increasing the cost of manufacturing, and preventing the machining tool from being damaged, by solving the aforementioned problems.

The above-mentioned object of the present invention is accomplished by a cathode-ray tube which has an electron gun that includes an electrode plate, wherein the electrode plate has a plurality of beam passage holes and bead supports, a portion having the beam massage holes and a portion having the bead supports are formed as a unitary structure, the two portions have different thicknesses, and steps are obliquely formed along the boundaries between the two portions.

Furthermore, a cathode-ray tube of the present invention has an electron gun that includes an electrode plate made by fabricating a metal plate such that a portion provided with a plurality of beam passage holes and a portion provided with bead supports are integrally formed, the two portions having different plate thicknesses, and accordingly steps are formed along the boundaries between the two portions, by punching the metal plate into a predetermined shape by press-forming, and then further punching the metal plate to make the beam passage holes.

According to the present invention, welding is eliminated since the portion having beam passage holes and the portion with bead supports are integrally formed together which have different thicknesses. Therefore, the productivity is improved and the manufacturing cost decreases. Moreover, since use is made of a metal plate that has a step in advance, no coining is required or the forming rate of coining is small, making it possible to prevent the machining tools from being damaged during the press-forming. Besides, since the step is obliquely formed, the burden of the punching tools can be small and is prevented from being damaged.

BRIEF DESCRIPTION OF THE DRAWINGS

FIG. 1(*b*) is a sectional view of the G3 electrode along the line A—A' in FIG. 1A;

FIG. 16(*b*) is a sectional view of the G3 electrode along the line B—B' of FIG. 16A.

DESCRIPTION OF THE PREFERRED EMBODIMENTS

Figure 1A:
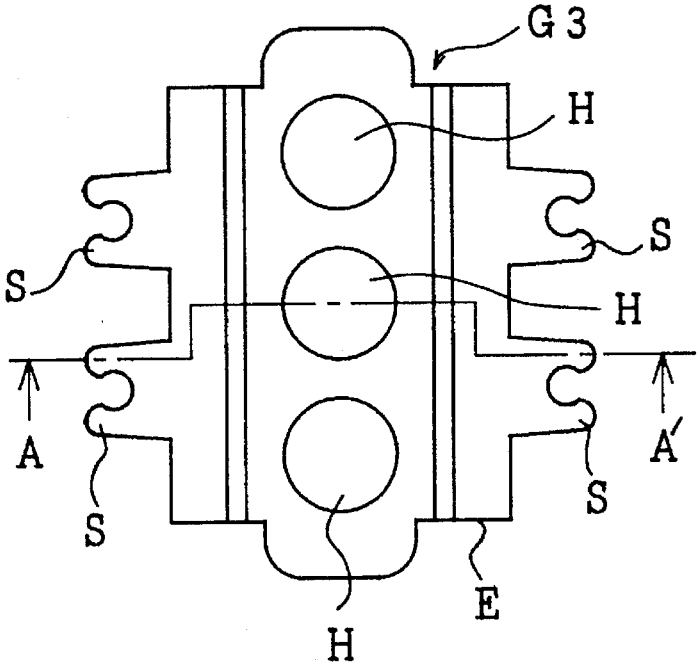
FIG. 1(*a*) is a plan view of a G3 electrode of an electron gun provided in a cathode-ray tube of an embodiment according to the present invention.
Figure 1B:
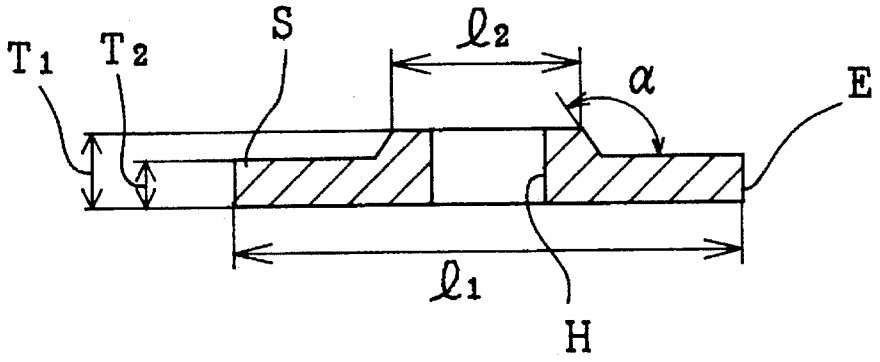
Figure 2A:
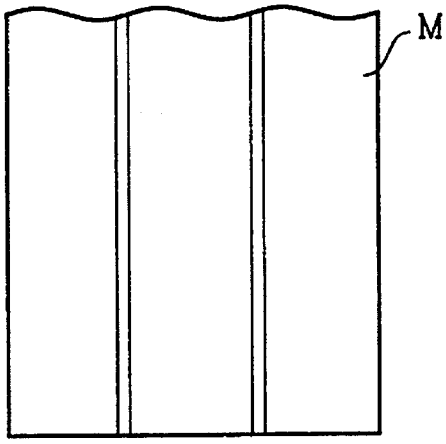
FIG. 2 is a diagram illustrating the steps for manufacturing the G3 electrode shown in FIGS. 1A and 1B.
Figure 2C:
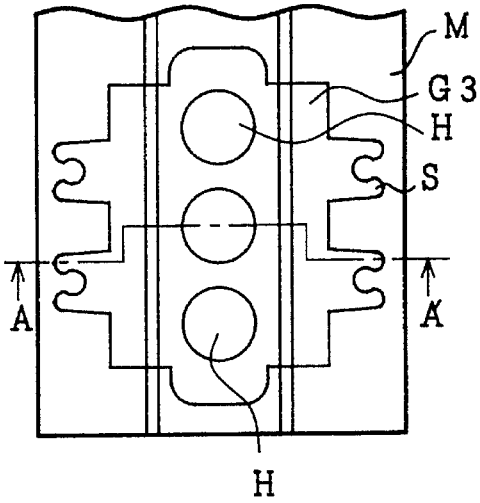
Figure 2B:
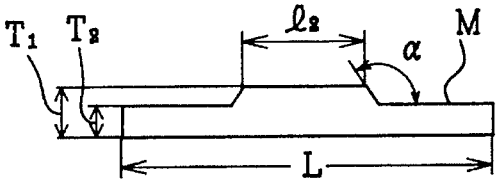
Figure 2D:
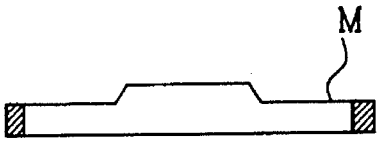
Figure 2E:
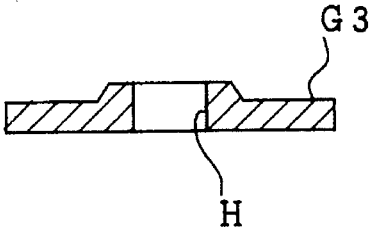
Figure 16A:
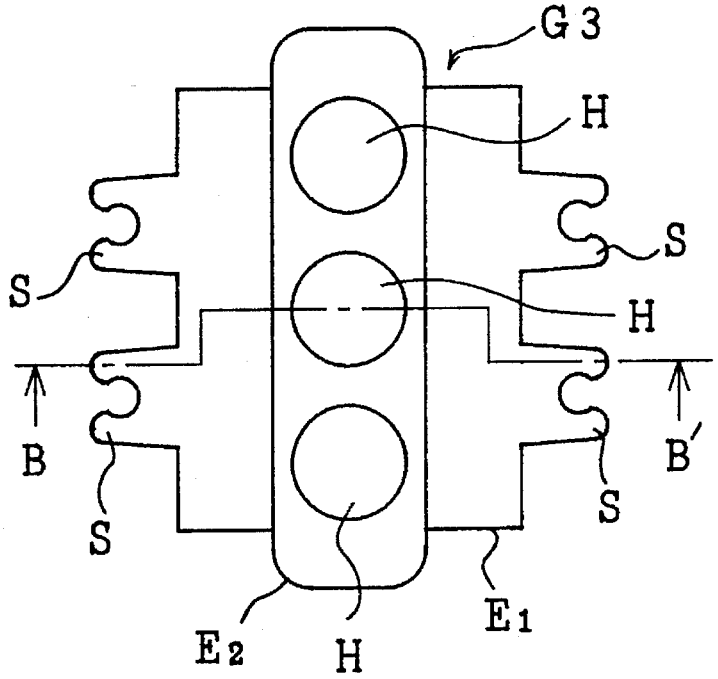
FIG. 16A PRIOR ART
FIG. 16(*a*) is a plan view of the G3 electrode constituting an electron gun provided in a conventional cathode-ray tube.
Figure 16B:
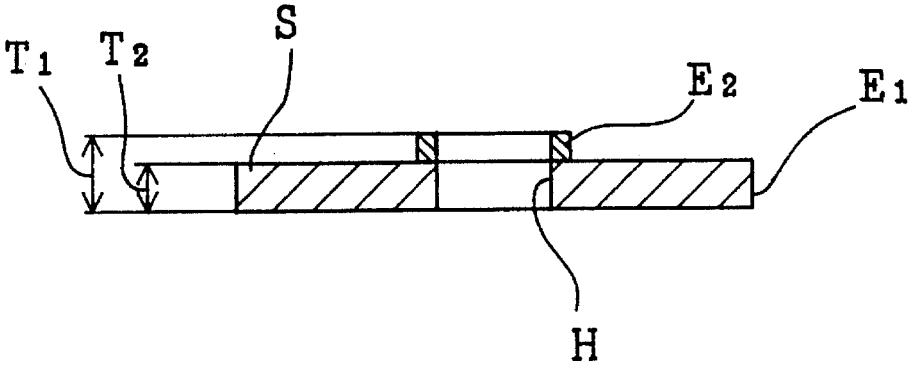
FIG. 16B PRIOR ART

An embodiment of the present invention will now be described with reference to FIGS. 1 and 2. Here, the same members as those shown in FIG. 16 are denoted by the same reference symbols and numerals.

FIG. 1(*a*) is a plan view of an electrode (G3 electrode) of an electron gun provided in a cathode-ray tube of an embodiment according to the present invention, and FIG. 1(*b*) is a sectional view of the G3 electrode taken along line A—A' of FIG. 1(*a*). In these drawings, symbol G3 denotes a G3 electrode, E denotes an electrode plate which constitutes the G3 electrode G3, symbol H denotes three beam passage holes formed in line in the electrode plate E, and symbol S denotes bead supports (portions for supporting the bead glass that is not shown) provided to the electrode plate E.

As shown, the G3 electrode G3 of this embodiment is made of a piece of an electrode plate E which has a portion in which three beam passage holes H are formed and a portion provided with bead supports S as a unitary structure, the two portions having different plate thicknesses, and steps being obliquely formed in the boundaries between the two portions. The reason why the thicknesses of the two portions are different and the steps are formed is to reduce the gap between the G2 electrode (not shown) and the G3 electrode G3 in order to improve the focusing performance without deteriorating the breakdown voltage characteristics.

In this embodiment, the thickness $T_1$ of the portion of the plate E where the beam passage holes H are formed is 1.0 mm, and the thickness $T_2$ of the portion where the bead supports S are provided is 0.7 mm. Further, the angles alpha in the steps are 135 degrees, and the width $l_1$, of the electrode plate E is 17 mm and the width $l_2$ is 7 mm.

FIGS. 2(*a*) to 2(*e*) are diagrams illustrating the process for fabricating the G3 electrode G3 that is shown in FIGS. 1(*a*) and 1(*b*). FIGS. 2(*a*) and 2(*c*) are partial plan views for illustrating a metal plate from which the G3 electrode of the embodiment is to be produced, FIG. 2(*b*) is a side view of the metal plate of FIG. 2(*a*), FIG. 2(*d*) is a side view of the metal plate of FIG. 2(*c*), and FIG. 2(*e*) is a side view of the G3 electrode G3 after it is punched. First, the metal material shown in FIGS. 2(*a*) and 2(*b*) is rolled to obtain a metal plate M having steps that have inclined walls and is continuously formed. The metal plate M of this embodiment is machined into a size of the final product. That is, the metal plate M has a thickness $T_1$ of 1.0 mm, a thickness $T_2$ of 0.7 mm, an angle alpha of 135 degrees, a width L of 20 mm and a width $l_2$ of 7 mm. Then, as shown in FIG. 2(*c*), predetermined three beam passage holes H and a predetermined outer shape are formed by punching by press to obtain the G3 electrode G3.

Here, the metal plate M can be pre-formed in a size which is slightly greater than that of the product, for example, in a size having a thickness $T_1$ of 1.0+0.1 mm and a thickness $T_2$ of 0.7+0.1 mm, and the size of the final product can be accomplished by coining during the press forming.

The portion having beam passage holes H and the portion having bead supports S of the G3 electrode shown in FIGS. 1A, 1B and 2A–2E are formed as a unitary structure even though they have different thicknesses $T_1$ and $T_2$. Therefore, welding is not necessary, and the productivity increases and the manufacturing cost decreases. Moreover, since use is made of a metal plate M that have steps formed in advance, no coining is required or the forming rate of coining can be small, making it possible to prevent the machining tools from being damaged during the press forming. Since the steps can be obliquely formed, the burden of the machining tools is made light and the tools are prevented from being damaged.

The aforementioned sizes of the embodiment are only illustrative, and a variety of sizes can be set as a matter of course. In the case of the metal plate M of FIGS. 2A–2E, roughly the sizes are desirably $T_1/T_2=1$ to 6, $l_2/L \leqq 0.8$.

Concretely described below is a cathode-ray tube to which the present invention can be adapted.

Figure 3:
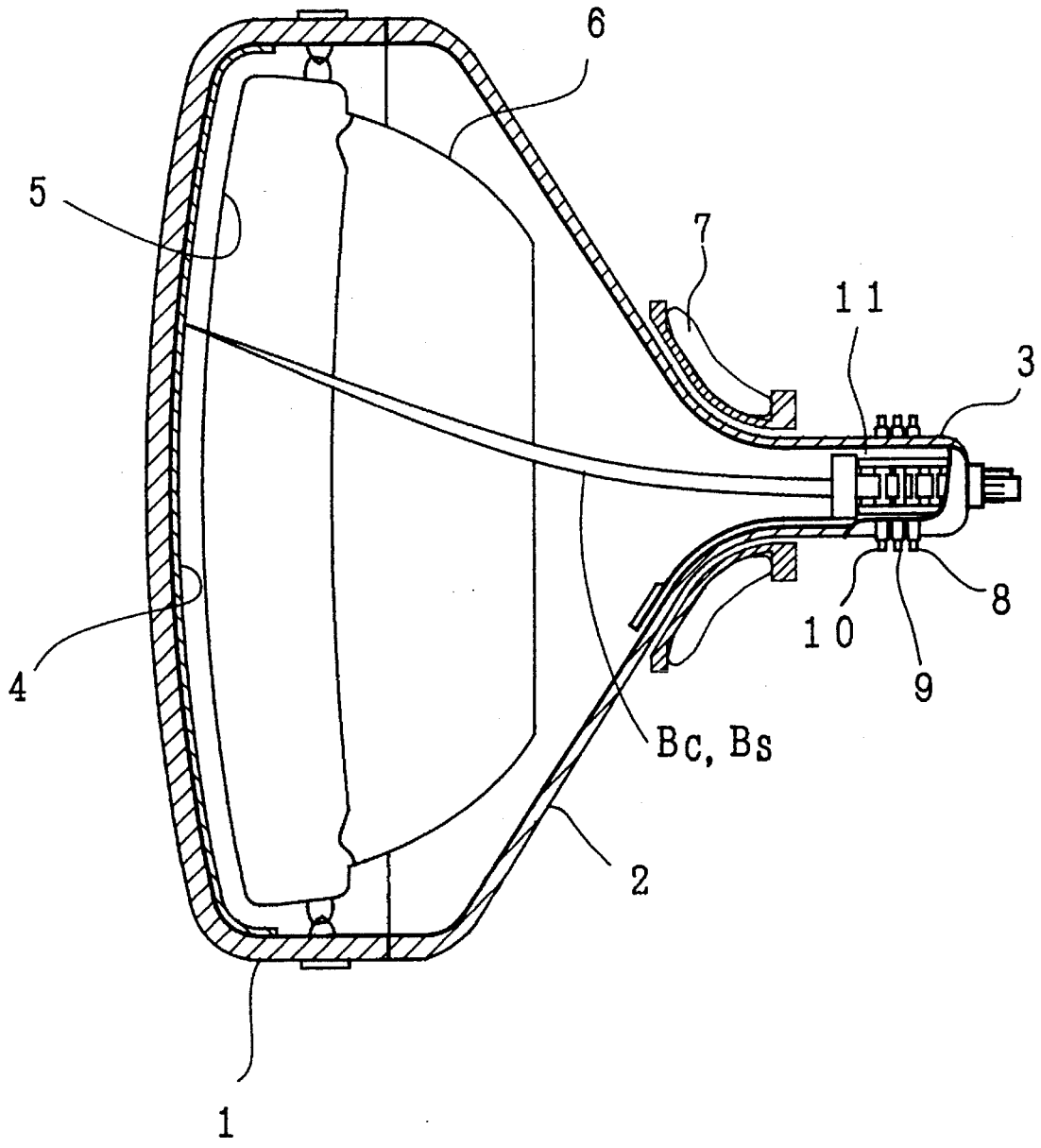
FIG. 3 is a sectional view of a color cathode-ray tube of the embodiment according to the present invention.

FIG. 3 is a schematical diagram illustrating the constitution of an embodiment of the present invention, wherein reference numeral 1 denotes a panel, 2 denotes a funnel, 3 denotes a neck part, 4 denotes a fluorescent screen, 5 denotes a shadow mask, 6 denotes a magnetic shield, 7 denotes a deflection yoke, 8 denotes a purity-adjusting magnet, 9 denotes a magnet for adjusting the center beam static convergence, 10 denotes a magnet for adjusting the side beam static convergence, 11 denotes an electron gun, symbol Bc denotes a center beam, and Bs denotes side beams.

The convergence (static convergence) of such a color cathode-ray tube is adjusted by first converging the two side beams Bs, Bs, and then causing the converging points of the center and side beams Bc, Bs, Bs to agree with each other.

On the outer surface of the panel i is formed, as required, a thin film of a single layer or a multilayer contains $SnO_2$, $In_2O_3$, etc. to prevent reflection and changing. Furthermore, though not diagramed, an inner electrically conducting film composed of graphite or the like is deposited on the inner surfaces of the funnel 2 and the neck 3. The electrically conducting film contains titanium dioxide and the like in addition to graphite to control its resistance. The film is for suppressing arc. The electrically conducting film electrically connects a high-tension terminal (not shown) to the electron gun 11.

FIG. 4 shows the electron gun 11, and is a sectional view of G3 and G4 electrodes that constitute a bipotential-type main lens in the horizontal direction and in the vertical direction. In FIG. 4, reference numeral 111 denotes the outer periphery of the G3 electrode, 121 denotes the outer periphery of the G4 electrode, and 13 denotes a cup electrode. Reference numeral 112 denotes an electrode for correcting astigmatism provided on the inside of the outer periphery 111 of the G3 electrode, and 122 denotes an electrode for correcting astigmatism provided on the inside of the outer periphery 121 of the G4 electrode. The electrode plate 112 has an aperture 114 for passing the center beam and apertures 113, 113' for passing the outer beams, and the electrode plate 122 has an aperture 124 for passing the center beam and apertures 123, 123' for passing the outer beams, all apertures being arranged in line. In this embodiment, the apertures 113, 113', 114, 123, 123' and 124 have oval shapes, and the corresponding apertures of the G3 electrode and the G4 electrode have the same shapes and the same sizes. When the apertures 113, 113', 123, 123' of the outer sides and the center apertures 114, 124 have the same shape and the same size, the main lens formed on the outer side exhibits a strong lens converging action in the horizontal direction. Therefore, the diameters of the apertures of the outer sides in the horizontal direction are selected to be greater than the inside diameters of the center apertures in the horizontal direction, in order to equalize the strengths of the converging actions in both the horizontal direction and the vertical direction.

Figure 4A:
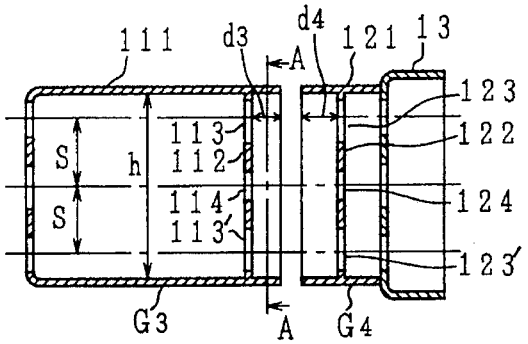
FIGS. 4A and 4B are sectional views illustrating an essential part of the electron gun of the present invention.
Figure 4B:
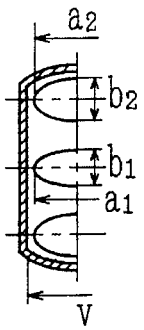
Figure 5:
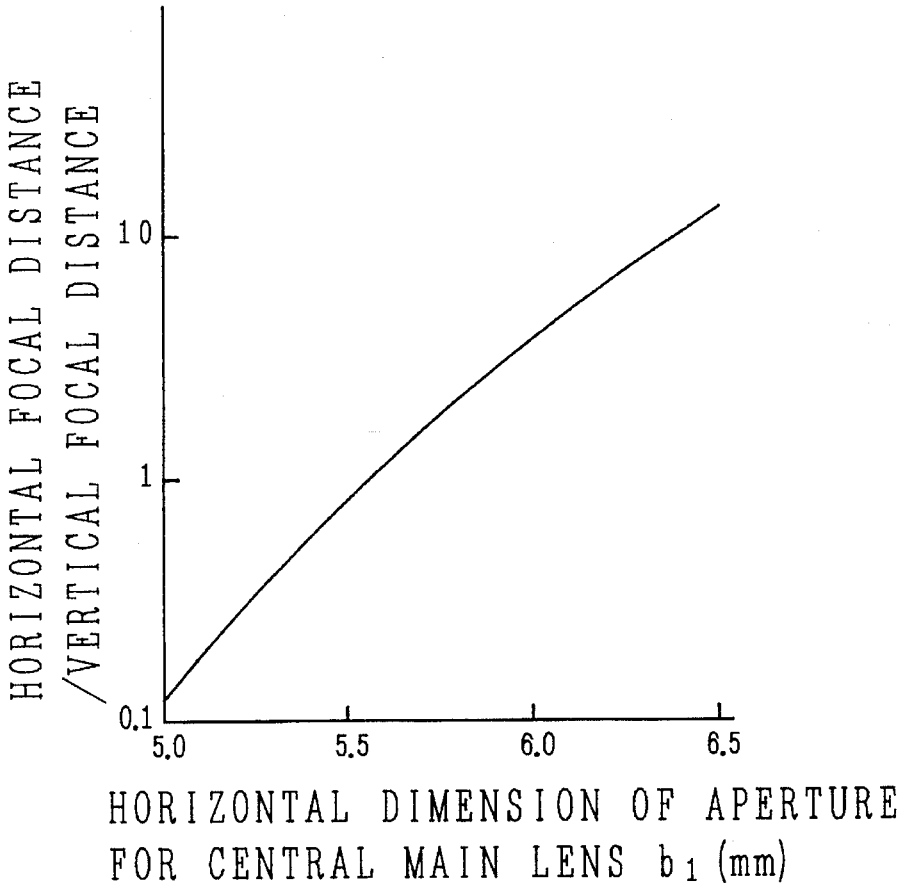
FIG. 5 is a diagram of characteristics of the electron gun shown in FIGS. 4A and 4B.

FIG. 5 shows the ratio of focal distances in both the horizontal and vertical directions relative to the diameter $b_1$ in the horizontal direction of the center apertures 114, 124 found by computer simulation in the embodiment shown in FIG. 4, where the inside diameters of the outer peripheries 111 and 121 in the horizontal direction are h=20.0 mm, the inside diameters in the vertical direction are v=9.4 mm, the diameters of the center apertures 114 and 124 in the vertical direction are $a_1$=8.4 mm, the recess depth of the electrode plate 112 is $d_3$=1.5 mm, and the distances from the center axis are S=6.6 mm.

Here, the focal distance in the horizontal or in the vertical direction means the distance from the end surface of the G3 electrode on the G4 electrode side up to the point where the electron beam crosses the center axis, the electron beam being emitted from a point on the center axis, having passed the horizontal or vertical axis of the center aperture and having focused by the main lens. The distance from the end surface to the fluorescent screen is set to be 340 mm, the outgoing points are found at which the outgoing angle can correspond to the value of 340 mm, and the electron beam is permitted to go out from an intermediate point of the above outgoing points at the same outgoing angle. FIG. 5 shows the ratio of focal distances in the horizontal direction and in the vertical direction in this case. As will be obvious from FIG. 5, when the diameter of the center aperture in the horizontal direction is $b_1$=5.5 mm, then the focal in the vertical direction and in the horizontal direction distances become in agreement, and the intensities of the converging actions in both directions becomes equal, making it possible to eliminate astigmatism.

In this case, the converging action of the lens is equal to that of a cylindrical bipotential lens of a diameter of 8 mm arranged with a gap of 1 mm.

This is greater than a limit value of 6.8 mm for the electrode aperture limited by L=h−2×S (where L=limit value of aperture diameter, h=diameter of aperture in the horizontal direction, S=distance from the center axis of aperture) when h=20.0 mm and S=6.6 mm.

Figure 6:
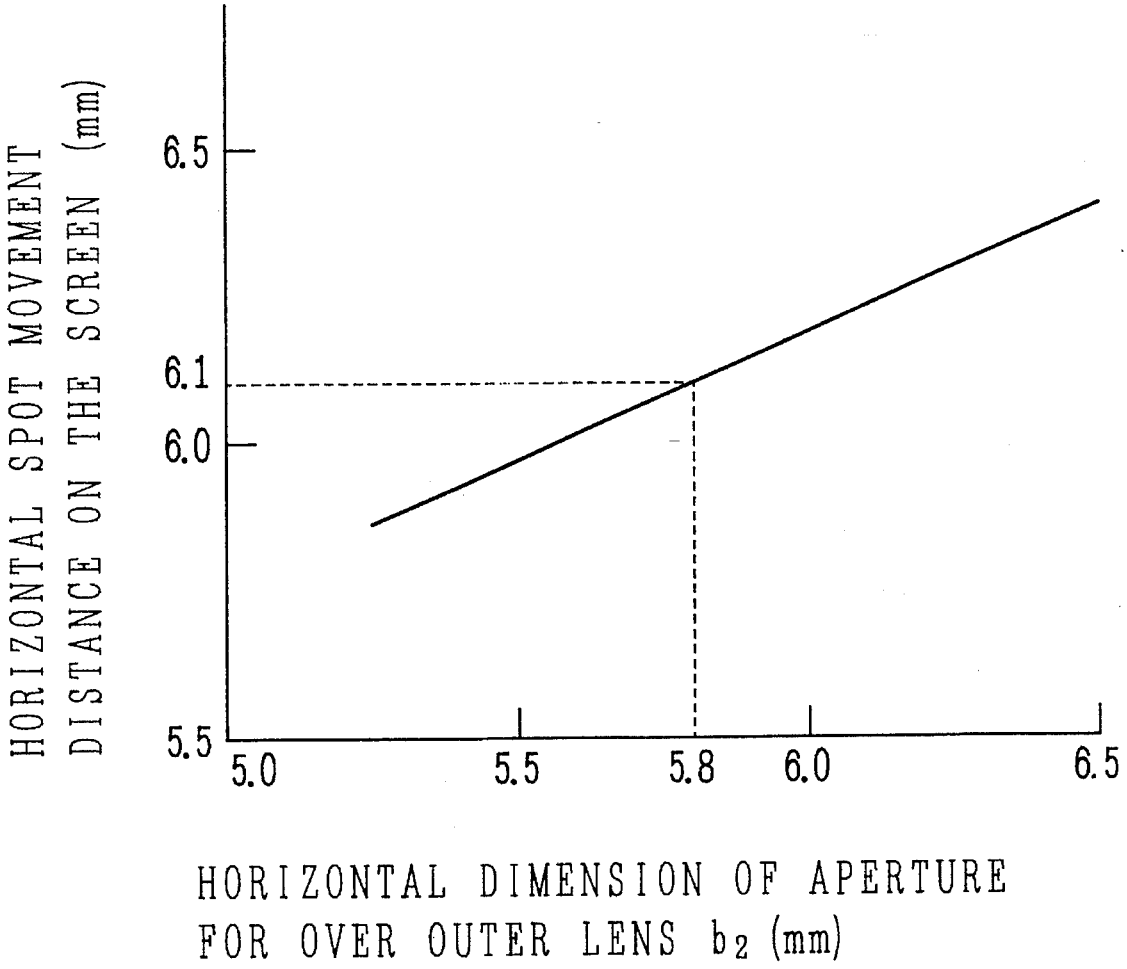
FIG. 6 is a diagram of characteristics of the electron gun shown in FIGS. 4A and 4B.

FIG. 6 shows the relationship between the diameters $b_2$ in the horizontal direction of the apertures 113, 113', 123, 123' of the outer sides and the horizontal spot movement distance of the electron beam of the outer sides on the fluorescent screen when the sizes are the same as those of the embodiment of FIG. 4. The relationship was found by computer simulation. A voltage of 7 KV is applied to the G3 electrode, a voltage of 25 KV is applied to the electrode G4, and the distance from the end of the G3 electrode on the side of the G4 electrode to the fluorescent screen is set to be 340 mm. The electron beams of the outer sides are separate from the center electron beam by 6.6 mm in the horizontal direction. Therefore, the spot movement distance is 6.6 mm that is necessary to achieve STC. In practice, however, the spot movement distance is in most cases designed to be about 6.1 mm to impart freedom for adjusting the color purity. To maintain this movement distance, the diameter $b_2$ should be 5.8 mm.

Figure 7:
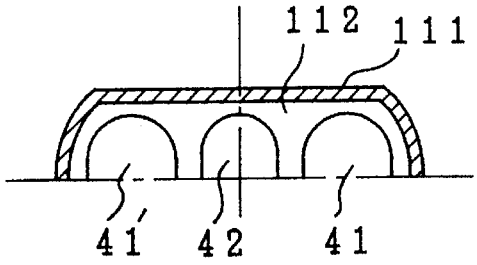
FIG. 7 is a sectional view showing an essential part of another embodiment of the electron gun of the present invention.

FIG. 7 is a sectional view illustrating an essential portion of an electron gun in the color cathode-ray tube of another embodiment according to the present invention, and shows the G3 electrode in cross section in the vertical direction. The apertures 41, 41', 42 formed in the electrode 112 have shapes in which the end points of the two arcs are connected together by two parallel lines. The spot shape on the fluorescent screen is not so good as that of oval apertures. However, the apertures which consist of arcs and lines can be formed easily and precisely. Even in this embodiment, the diameters of the apertures in the horizontal direction are smaller than those in the vertical direction.

Figure 8:
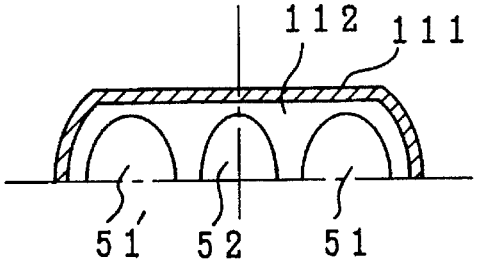
FIG. 8 is a sectional view showing essential part of a further another embodiment of an electron gun of the present invention.
Figure 9:
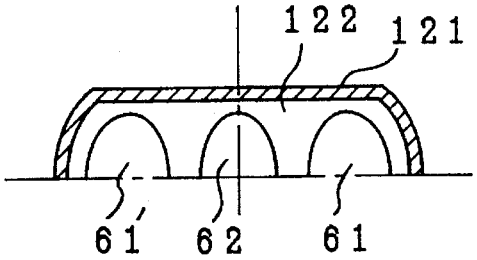
FIG. 9 is a sectional view showing an essential part of a further another embodiment of the electron gun of the present invention.

FIGS. 8 and 9 are sectional views illustrating an essential portion of the electron gun of a further embodiment according to the present invention, and show the G3 electrode and the G4 electrode in cross section in the vertical direction. The center apertures 52, 62 have a symmetrical axis in the vertical direction but the apertures 51, 51', 61, 61' of the outer sides have no symmetrical axis in the vertical direction. The apertures 51, 51', 61, 61' of the outer sides each consist of a combination of two ovals having the same major axes but different minor axes. In the outer apertures 51 and 51' of the G3 electrode, the ovals on the outer sides have minor axes smaller than those of the inner sides. By forming the outer apertures of the G3 electrode in such a shape, the electron beam can be converged in the center direction more strongly than when the apertures each consist of a single ellipse as denoted by 113 and 113' in FIG. 4. Therefore, the STC can be achieved even when the diameter is further decreased in the horizontal direction.

In the G4 electrode, on the other hand, the outer apertures designated by 61 and 61' in FIG. 9 are constituted by a combination of such two ovals that the oval of the inner side has a short minor axis smaller than that of the oval of the outer side, so that the electron beam is converged toward the center more strongly.

Thus, if the apertures of the outer sides are asymmetrically formed with respect to the vertical direction, the electron beam is more converged making it easy to accomplish the STC. When the converging force is too strong, the apertures of the G4 electrode are formed as in FIG. 8, and the apertures of the G3 electrode are formed as in FIG. 9 to weaken the converging force.

When main lenses corresponding to red, green and blue three colors are arranged in parallel on the same horizontal plane under the limitation of the outer shape of the electron gun, the present invention makes it possible to constitute main lenses having converging action weaker than that of when cylindrical electrodes having maximum diameters are arranged. It is therefore possible to strikingly improve the converging performance of the color cathode-ray tube.

Furthermore, the STC can be accomplished by properly selecting the recess amount of the electrode plate and the shapes of apertures formed in the electrode plates without shifting the center axes of the outer apertures formed in the G3 electrode and the G4 electrode that constitute main lens. During the assembling, therefore, jigs having the same diameters and the same axes can be used for the G3 electrode and the G4 electrode to improve assembling precision.

Figure 10:
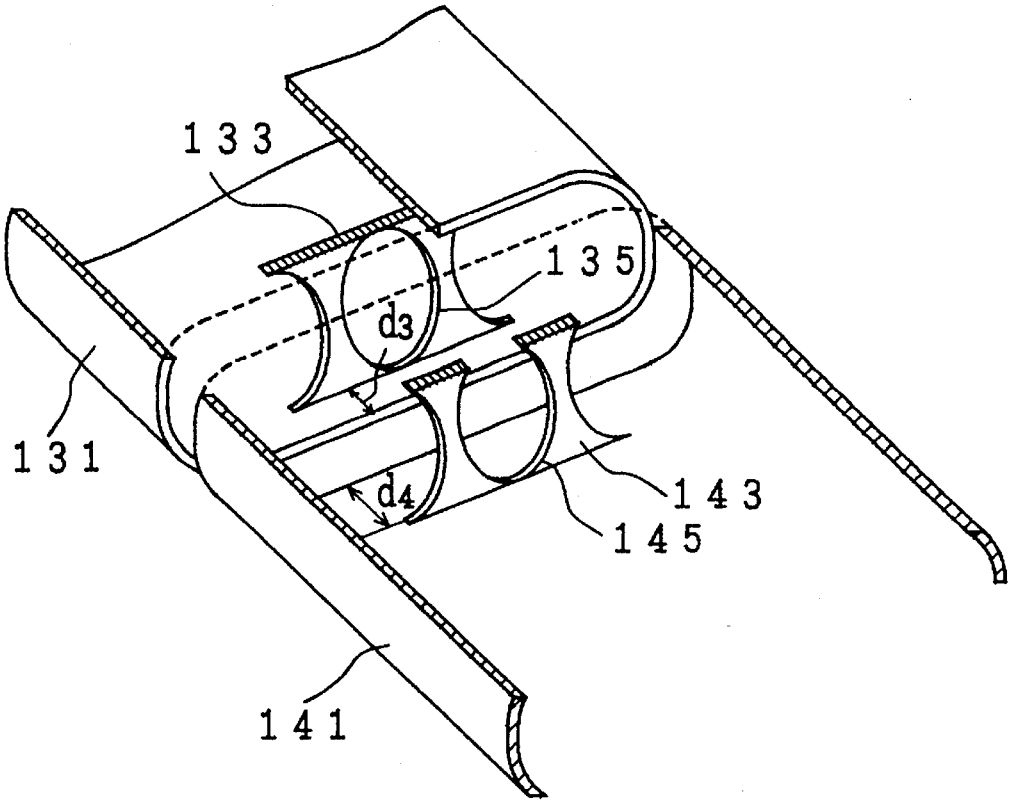
FIG. 10 is a partly cut-away sectional view showing an essential part of further another embodiment of the electron gun of the present invention.

FIG. 10 is a partly cut-away perspective view illustrating an essential part of an electron gun of another embodiment according to the present invention, wherein the electrode plates 133 and 143 have oval apertures 135 and 145 for the center beam like those of the electrode plates of FIGS. 4A and 4B, but have oval apertures for the side beams of both sides that are cut into halves. That is, the apertures have no portion that comes in contact with the outer peripheral electrodes 131, 141 at both the right and left ends. The passage for the center beam is surrounded by the apertures 135 and 145 formed in the electrode plates 133 and 143, and the passages for the side beams on both sides are partly surrounded by the ends of the electrode plates 133, 143 and the remaining portions are surrounded by the outer peripheral electrodes 131 and 141. Such a structure makes it possible to maximize the aperture of the main lenses for the side beams. Moreover, the electrode plates having small areas makes it possible to easily accomplish good flatness. Besides, since oval apertures that require high precision are formed less, the machining can be easily performed. Symbols $d_3$ and $d_4$ denote recess amounts which may be the same or different.

In the embodiment of FIG. 10, though the apertures are of oval shapes, the astigmatism can be removed even in the case of apertures having diameters in the vertical direction are greater than those in the horizontal direction.

Figure 11:
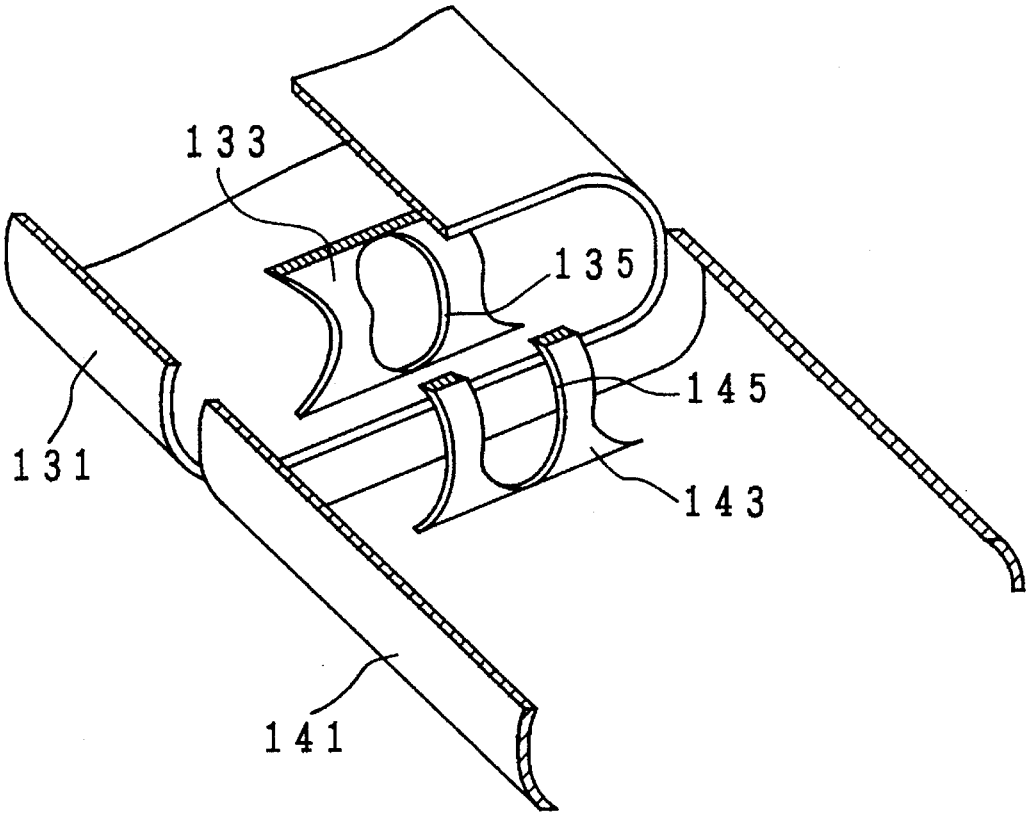
FIG. 11 is a partly cut-away perspective view showing an essential part of further another embodiment of the electron gun of the present invention.

As shown in FIG. 11, furthermore, the astigmatism can be removed even by curving the electrode plates 133 and 143 and by continuously changing the recess amounts of the electrode plates. In this case, the diameters of the apertures 135 and 145 in the vertical direction need not necessarily be greater than those in the horizontal direction. When the electrode plate 133 of the G3 electrode is convexed toward the G4 electrode as shown, the converging force can be increased in the horizontal direction. Conversely, when the electrode of the G4 electrode is convexed toward the G3 electrode, the converging force can be increased in the vertical direction.

Figure 12:
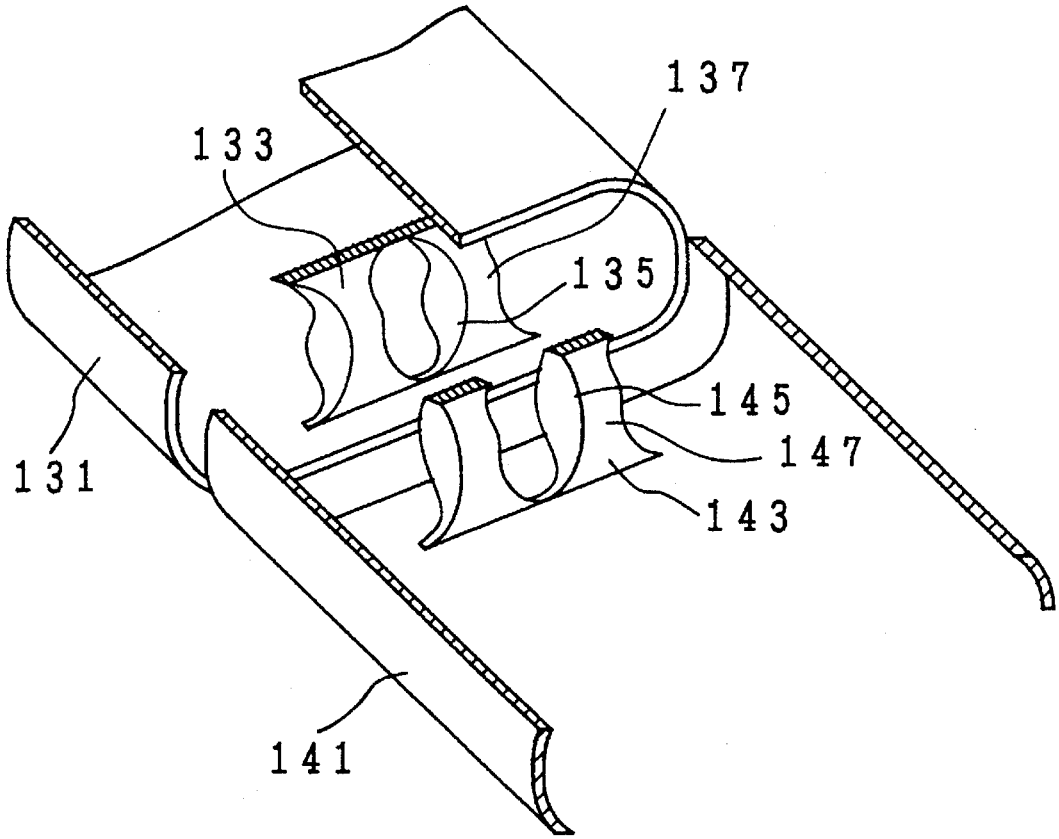
FIG. 12 is a partly cut-away perspective view showing an essential part of a yet further embodiment of the electron gun of the present invention.
Figure 13A:
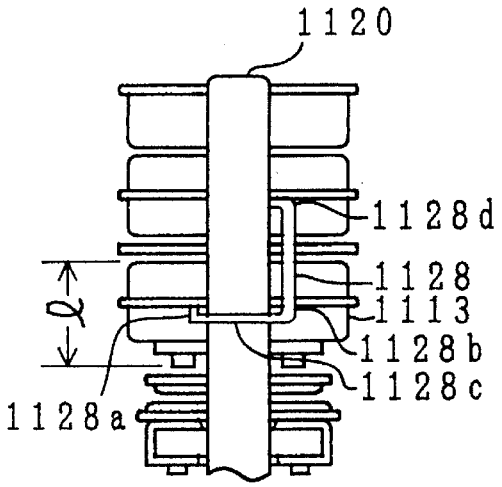
FIG. 13 includes a front view, a side view, a rear view and a plan view of a yet further embodiment of the electron gun of the present invention.
Figure 13B:
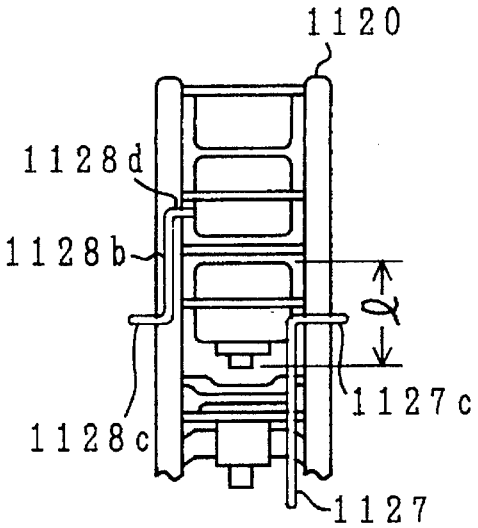
Figure 13C:
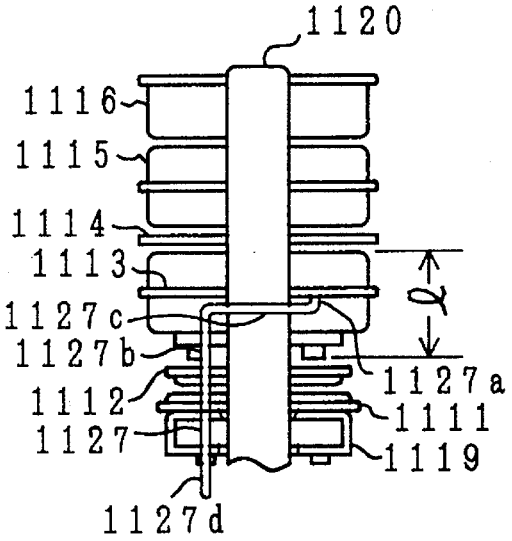
Figure 13D:
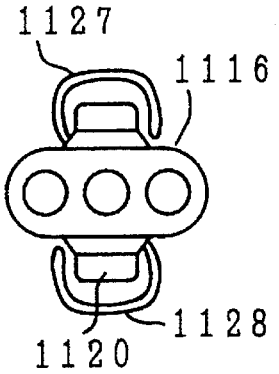

As shown in FIG. 12, furthermore, the astigmatism can be corrected by providing protrusions 137 and 147 around the apertures 135 and 145 and by adjusting the height of the protrusions. Even in this case, the diameters of the apertures in the vertical direction needs not be greater than those in the horizontal direction.

In the embodiments of FIGS. 11 and 12, the astigmatism can be corrected with apertures of true circles offering an advantage that parts can be machined and the electrodes can be assembled more easily than the cases of apertures of non-circular shapes.

The above embodiments make it possible to remove halo that generates toward the inner sides of side beams, to sufficiently increase the effective aperture of main lenses in the electron gun, and to strikingly improve the converging performance of the color cathode-ray tube. Furthermore, the mutually facing electrodes have small areas in the main lens making it easy to accomplish good flatness during the machining. In addition, the shaping is easily done since relatively small portions need machining.

The electron gun of the present invention can be applied to the main lens of the above-mentioned bipotential type and of any other types, as a matter of course. In the above description, furthermore, the invention is adapted to both of the pair of electrodes constituting the main lens. However, the same effects can be obtained even when the invention is adapted to either one of the electrodes.

FIG. 13 includes a front view (a), a side view (b), a rear view (c) and a plan view (d) of an electron gun having first to sixth grids of a further embodiment, wherein reference numeral 1111 denotes a first grid, 1112 denotes a second grid, 1113 denotes a third grid, 1114 denotes a fourth grid, 1115 denotes a fifth grid, 1116 denotes a sixth grid, and reference numeral 1119 denotes a cathode. This electron gun uses a plurality of main lenses to obtain good focusing performance. To obtain an image which is bright and has a high resolution, the anode voltage Eb must be high and is usually from 25 to 35 KV. A focusing voltage $Ec_3$ is about 30% of the Eb, a voltage $Ec_2$ of about 400 to 700 V is applied to the second grid 1112, the first grid 1111 is grounded, and a signal voltage Ek of smaller than 200 V corresponding to the brightness of each pixel is applied to the cathode 1119. Reference numeral 1127 denotes a third grid feeder line and 1128 denotes a fifth grid feeder line. As shown in FIGS. 13B and 13C, one end 1127*a* of the third grid feeder wire 1127 is fixed to the third grid 1113, part of the intermediate portion 1127*b* is a bent portion 1127*c* that extends nearly in parallel with a plane perpendicular to the tubular axis, the bent portion 1127*c* passes through between the back surface of a bead glass 1120 and the wall surface (not shown) in the neck tube within the full length l of the third grid 1113 in the direction of the tubular axis, and the other end 1127*d* of the feeder wire 1127 is connected to a stem lead that is not shown. Thus the third grid feeder wire can serve as a shielding wire. As shown in FIGS. 13(*a*) and 13(*b*), one end 1128*a* of the fifth grid feeder wire 1128 that connects the third grid 1113 to the fifth grid 1115 is fixed to the third grid 1113, the other end 1128*d* of the wire 1128 is fixed to the fifth grid 1115, part of its intermediate portion 1128 is a bent portion 1128*c* that extends nearly in parallel with a plane perpendicular to the tubular axis, the bent portion 1128*c* is arranged symmetrically to the above bent portion 1127*c* within with the tubular axis interposed between the two bent portions 1127*c* and 1128*c* the full length l in the direction of the tubular axis of the third grid 1113 on a plane perpendicular to the tubular axis, and the bent portion 1128*c* passes through between the back surface of the bead glass 1120 and the wall surface (not shown) in the neck, in order to obtain the same action as the shielding wire. That is, since the feeder wires 1127*c* and 1128*c* are symmetrically arranged on the same plane perpendicular to the tubular axis, and sandwhich the tubular axis therebetween, an excellent effect of suppressing the arc discharge over the whole periphery in the neck tube is exhibited compared with those in which the shielding wire is arranged on one side only.

By symmetrically arranging the two folded portions 1127*c* and 1128*c* within the full length of the third grid in the direction of the tubular axis and by interposing the tubular axis therebetween as in this embodiment, furthermore, the number of times of the occurrence of arc discharge can be decreased to be a fraction of conventional one and the dark current can be decreased to be one-several hundredth or less. That is, the bent portions are preferably provided in positions close to the electrode to which the anode voltage is applied from the standpoint of shielding the bead glass and the tubular wall of the neck from the anode voltage. However, this arrangement might result in local concentration of electric field at places where the feeder wires are bent, contrarily causing arc discharge easily. When the bent portions of the feeder wires for applying the focusing voltage are too close to the second grid electrode, on the other hand, the focusing voltage which is high next to the anode voltage is very likely to develop arc discharge between the bent portions of the feeder wires for applying the focusing voltage and the electrode for applying a low voltage such as the second grid electrode.

Extensive experiments concerning the effect of suppressing the occurrence of arc discharge, effect of suppressing the dark current and the operability of assembling electrodes teach that the bent portions of the feeder wires for applying the focusing voltages should best be provided at places that face to the side surfaces of the third grid within the full length l thereof in the direction of the tubular axis.

According to this embodiment in which both ends of the feeder wires are fixed to the electrodes or the like, the feeder wires are not the source of stray electrons making it possible to prevent the occurrence of arc discharge and to suppress the dark current.

Figure 14:
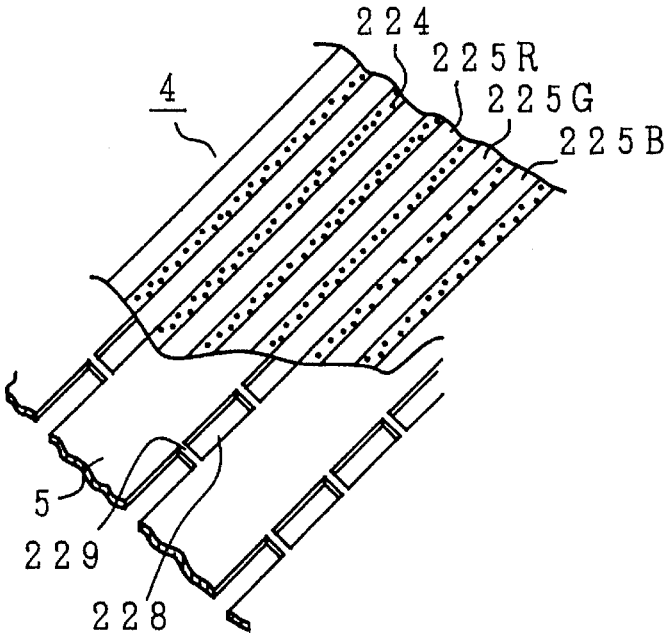
FIG. 14 is a partly cut-away perspective view showing an essential part of an example of a fluorescent screen and a shadow mask of the present invention.

FIG. 14 illustrates in detail the fluorescent screen 4 and the shadow mask 5, wherein the fluorescent screen 4 formed in the inner surface of the panel unit has a number of light-absorbing strips 224 that extend continuously in the vertical direction and are arranged in the horizontal direction. Among the light-absorbing strips 224, a plurality of fluorescent strips 225R(red), 225G(green), 225B(blue) that emit light of different colors and that continuously extend in the vertical direction in a predetermined order in the horizontal direction are provided. On the inner surface of the panel, furthermore, the curved shadow mask 5 is correspondingly arranged to face the fluorescent screen 4. The shadow mask 5 has a number of through slits 228 that are long in the vertical direction in correspondence with the fluorescent strips 225 continuously extending fully in the vertical direction, divided in the vertical direction via bridges 229, and arranged in the horizontal direction at predetermined pitches in columns.

Figure 15:
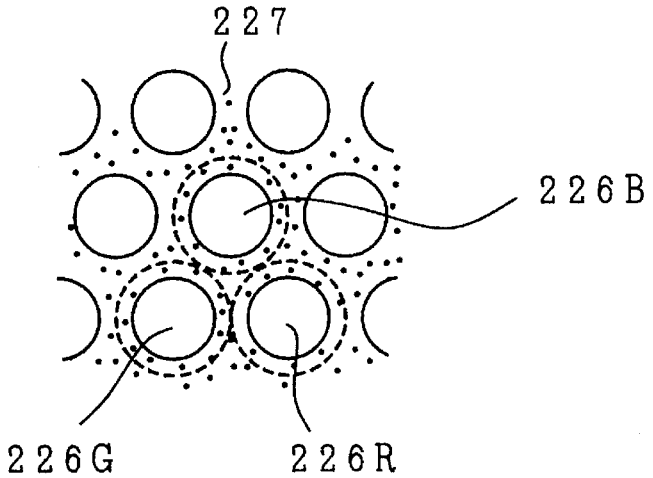
FIG. 15 is a plan view showing an essential part of another example of the fluorescent screen of the present invention.

FIG. 15 illustrates another embodiment of the fluorescent screen 4 which has dot-like fluorescent spots 226R(red), 226G(green), 226B(blue), and a light-absorbing film 227 with which the surroundings of the spots are filled.

The shadow mask 5 is made of steel plate and invar material having a small coefficient of thermal expansion. Though not diagramed, the shadow mask 5 can be covered with bismuth or the like to suppress the thermal expansion. It is allowable to form circular through holes instead of the through slits 228.

The invention is in no way limited to the above described embodiments only, but can be modified in a variety of other ways without departing from the gist and scope of the invention. In the embodiment shown in FIG. 1, for instance, the portion having beam passage holes H has a thickness greater than that of the portion having bead supports S. The invention, however, can be adapted even to the opposite case. In the steps shown in FIG. 2, furthermore, the plate from which the metal plate M is formed can have the size of the final product, or the plate can have a slightly larger size which can then be reduced to the size of the final product through the coining of the metal plate M at the time of press forming. As in the embodiment of FIG. 2, furthermore, the outer shape of the G3 electrode G3 and the beam passage holes H can be simultaneously punched from the metal plate M during the press forming. When they are not simultaneously punched, either one of them can be punched first. Moreover, the step portions need not necessarily be formed inclinedly.

In the electrode plate constituting the electron gun in the cathode-ray tube of the present invention as described above, the portion having beam passage holes and the portion having bead supports can be formed as a unitary structure easily and highly accurately, eliminating the conventionally employed process of welding, and enabling the productivity to increase and the manufacturing cost to decrease. Moreover, since use is made of a material having steps formed in advance, the productivity increases and the machining tool is prevented from being damaged during press forming.

We claim:

1. A method of making an electrode plate of an electron gun having at least one electrode plate, comprising the steps of:

rolling a metal plate so as to have a thick central portion and thin side portions with steps having inclined and continuous walls between the thick central portion and the thin side portions; and press working the thick central portion to form electron beam passage holes therein and press working the thin side portion to configure the outer shape of the electrode plate.

2. A method according to claim 1, wherein the step of press working the beam passage holes and the outer shape of the electrode plate is effected simultaneously.

3. A method according to claim 1, wherein the step of rolling the metal plate includes rolling the metal plate to have a ratio of the thickness of the thick central portion to a thickness of the thin side portions of no greater than 6.

4. A method according to claim 3, wherein the ratio of thickness of the thick central portion to the thickness of the thin side portion is less than 6.

5. A method of making an electrode plate of an electron gun having at least one electrode plate, comprising the steps of:

rolling a metal plate so as to have a thick central portion slightly thicker than a final thickness therefor, thin side portions slightly thicker than a final thickness therefor, and steps having inclined and continuous walls between the thick central portion and the thin side portions; and coining the thick central portion to the final thickness therefor and press working the thick central portion to form electron passage holes therein, and coining the thin side portions to the final thickness therefor and press working the thin side portions to configure the outer shape of the electrode plate.

* * * * *